US006370928B1

(12) United States Patent
Chies et al.

(10) Patent No.: US 6,370,928 B1
(45) Date of Patent: Apr. 16, 2002

(54) MECHANO-ELECTRONICALLY OPERATED CYLINDER-KEY UNIT FOR LOCKS

(76) Inventors: Ezio Chies, Via Caronelli, 37/8, 31014 Colle Umberto (IT); Paolo Fornasari; Giovanni Pradella, both of Via Podgora, 20, 31029 Vittorio Veneto (IT)

( * ) Notice: Subject to any disclaimer, the term of this patent is extended or adjusted under 35 U.S.C. 154(b) by 0 days.

(21) Appl. No.: 09/509,701

(22) PCT Filed: Sep. 7, 1998

(86) PCT No.: PCT/EP98/05653

§ 371 Date: Mar. 30, 2000

§ 102(e) Date: Mar. 30, 2000

(87) PCT Pub. No.: WO99/18310

PCT Pub. Date: Apr. 15, 1999

(30) Foreign Application Priority Data

Oct. 3, 1997 (IT) ..... VE97A0043

(51) Int. Cl.[7] ..... E05B 49/00

(52) U.S. Cl. ..... 70/278.3; 70/278.2; 70/278.7; 70/279.1; 70/283.1

(58) Field of Search ..... 70/215, 278.2, 70/278.3, 278.7, 283.1, 308, 356, 357, 406, 283, 279.1

(56) References Cited

U.S. PATENT DOCUMENTS 4,708,004 A * 11/1987 Allen ..... 70/226
5,277,042 A * 1/1994 Tobias ..... 70/209

FOREIGN PATENT DOCUMENTS

| | | |
|---|---|---|
| DE | A19519789 | 12/1996 |
| FR | A1321583 | 6/1963 |
| WO | A9602721 | 2/1996 |

* cited by examiner

*Primary Examiner*—Gertrude Arthur
(74) *Attorney, Agent, or Firm*—Birch, Stewart, Kolasch & Birch, LLP

(57) ABSTRACT

A mechano-electronically operated cylinder-key unit for locking including a cylinder unit and key. The cylinder unit having a cylinder portion, a pawl for operating a bar for locking/unlocking, an electrical energy generator for powering an electronic circuit provide in the cylinder unit, whereby a triggering member activates the electrical energy generator when a predetermined extent of insertion of the key into the cylinder is exceeded. The key is also provided with an electronic circuit whereby both electronic circuits are provide with a control logic for recognizing and allowing operation of the pawl.

23 Claims, 6 Drawing Sheets

MECHANO-ELECTRONICALLY OPERATED CYLINDER-KEY UNIT FOR LOCKS

This application is the national phase under 35 U.S.C. § 371 of PCT International Application No. PCT/EP98/05653 which has an International filing date of Sep. 7, 1998, which designated the United States of America.

FIELD OF THE INVENTION

This invention relates to a mechano-electronically operated cylinder-key unit for locks.

DESCRIPTION OF THE PRIOR ART

Mechanically operated cylinder-key units for locks are known. The cylinder comprises a metal body with a cylindrical portion and an appendix extending radially from this latter. Within the cylindrical portion there is provided a cylindrical seat housing a rotary plug provided with a plurality of radial recesses, which when in a predetermined angular position extend into recesses provided in the appendix. These recesses house axially movable pins divided into two portions, the separation surface of which, for a predetermined axial position of each pin in its respective recess, corresponds with the separation surface between the plug and its seat. This axial position, which is different for each pin, is determined by the pattern notches of a key inserted into a corresponding slot in the plug, and following this insertion enables the plug to be rotated, with consequent operation of the lock bolt via a pawl rigid with said plug.

This type of mechanically operated unit has been and is still widely used, but also has a series of drawbacks such as:

- a limited degree of security because of the substantially limited number of possible key patterns;
- the possibility of recognizing the key pattern "on sight";
- key wear deriving both from use, because of the continuous rubbing between the cylinder and the teeth defining the key notches, and from key duplication, as a result of contact between the feeler and the patterned key to be duplicated;
- cylinder sensitivity to atmospheric conditions.

To increase the degree of security of these known units it has been sought to make the key-cylinder interfacing mechanism increasingly more complicated so as to increase the number of possible patterns obtainable, but with this increase in pattern number there is a correspondingly lower reliability and strength of the unit.

For this reason, lock operating systems have been already proposed using electrical or electronic circuits able to electronically control a code memorized in the cylinder using a code memorized in the key or vice versa.

The need to use electrical power is a considerable inconvenience:

- if the electronical power derives from the mains, difficulties arise in installing the lock and moreover the system can be used only if a mains supply is present, it becoming unusable if the supply fails; if however the electricity derives from a self-contained source, the state of its charge must be systematically checked.

To avoid these drawbacks it has been proposed to provide mixed units, ie mechanically operated but with an electronic control system powered by electrical energy generated by inserting the key into the lock cylinder or by rotating the key already inserted into it.

For example FR-A-2500520 (THOMSON-CSF) describes a unit of this type in which the electrical energy required for effecting key-cylinder recognition and for powering the electromechanical bolt release member on positive recognition is obtained by a piezoelectric effect by virtue of the action exerted on piezocrystals when the key is inserted, withdrawn or rotated, these being arranged along the lock channel.

A drawback of this arrangement is the very small amount of electricity produced, this generally being insufficient to satisfy the required electrical loads, which are themselves modest; a further drawback is the pulse nature of the electrical energy produced, incompatible with the particular type of electrical loads employed; a further drawback is the nature of the memorized code resident in the key and the method of transmitting the relative data to the reading, recognition and enabling circuits resident in the lock mechanism In this respect, if this code is of mechanical type and operates by pressure against appropriate feelers in the lock, it is easily decoded on sight; if it is of magnetic type it can be easily cancelled or altered; if it is of optical type it is very complicated and requires considerable energy for its operation.

U.S. Pat. No. 5,265,452 (DAWSON) describes a unit comprising a cylinder into which a key comprising a memorized code can be inserted and rotated. The rotation of the inserted key generates sufficient electrical energy to power the electrical circuit by which the lock recognizes the key code and, on positive recognition, to effect engagement between gearwheels enabling the lock bolt to be operated by the key.

This known solution, which inter alia is described in terms of general principles without any mention of the manner of energizing the electronic circuit provided in the key, or the reading and control arrangements provided external to the key, has the drawback of considerable constructional complexity and the practical impossibility of totally housing it within a traditional interchangeable European lock cylinder, hence limiting its application only to locks expressly constructed for this purpose.

EP-B1-0771381 (SILCA) describes an electromechanically operated cylinder-key unit for locks, using control and recognition logic housed partly in the key and partly in the lock, and mutually interacting via a connection without wires when the key is inserted into the lock, and further using, for the electrical energy required to power said logic, a generator which is operated on inserting the key into the cylinder and/or on rotating the cylinder by the key inserted into it.

This known solution has practically eliminated the previously recognized drawbacks, but at the same time has proved susceptible to improvement, in that:

- the electrical energy is not generated uniformly, but is instead related to the mechanical torque applied to the key to rotate the generator, and to the angular velocity imposed by the key by virtue of its rotation or to the velocity with which the key is inserted into the cylinder plug,
- the electrical energy generation system, and in particular the combination of the energy transformers of the entire chain, is of very low efficiency,
- consequently the energy available for effecting the mechanical connection between the key and the operating pawl of the lock bar is low and is often not able to adequately power the electromagnet which determines this connection.

BRIEF SUMMARY OF THE INVENTION

These and other drawback are eliminated according to the invention through a mechano-electronically operated cylinder-key unit for locks a mechano-electronically operated cylinder-key unit for locks, comprising a cylinder having a pawl which operates a bar and housing an electrical energy generator for powering an electronic circuit provided in said cylinder and for powering, by way of an inductive coupling when said key is inserted into said cylinder, an electronic circuit provided within said key, both said electronic circuits being provided with control logic for their recognition and for allowing, on positive recognition, said operation of said pawl by said key wherein said cylinder comprises:

means for mechanically locking the pawl when said key is withdrawn or is not recognized, an electrical generator activated by a triggering member when a predetermined extent of insertion of said key into said cylinder is exceeded, and means for transforming, on positive recognition, the kinetic energy of said triggered generator, in a deactivation movement of said mechanical locking means.

BRIEF DESCRIPTION OF THE DRAWINGS

A preferred embodiment of the present invention is described in detail hereinafter with reference to the accompanying drawings, on which.

DESCRIPTION OF PREFERRED EMBODIMENTS

Figure 1:
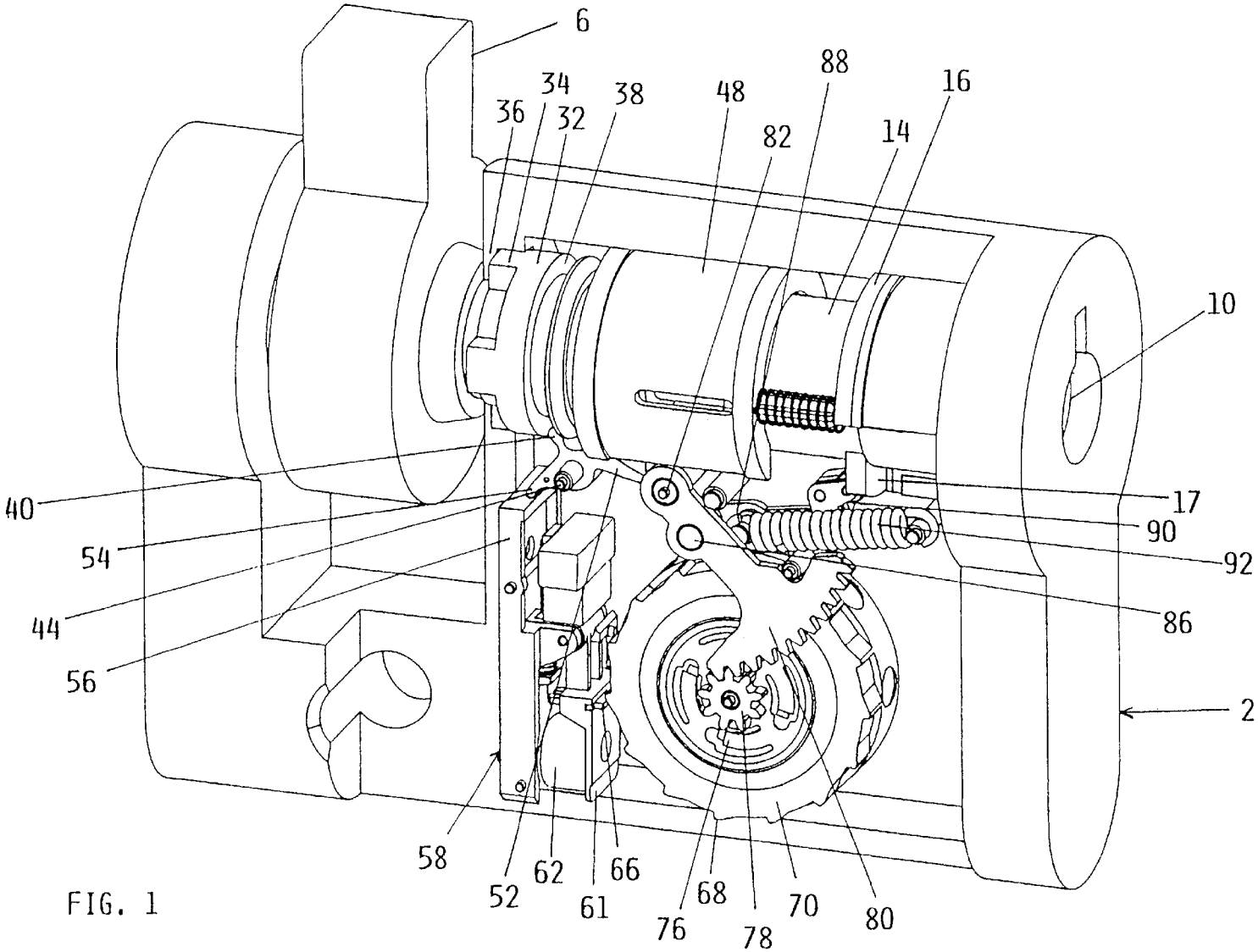
FIG. 1 is a partly sectional general perspective view of a European cylinder of the unit of the invention in the locked state without the key.

As can be seen from the figures, the unit of the invention comprises a cylinder of "European" type indicated overall by 2, and a key indicated overall by 4 and provided for engagement with said cylinder 2.

In the representation the cylinder 2 in reality consists of a half-cylinder, and hence allows insertion of the key 4 from only one end. However in the case of a complete cylinder, that described hereinafter in duplicated on the other of the pawl 6 which operates the bar (not shown).

The cylinder 2 of the unit according to the invention has the traditional external configuration of European cylinders, with a cylindrical portion into which the key 4 can be inserted, and an appendix extending radially from said cylindrical portion. The dimensions of the cylinder 2 are also traditional, this making the cylinder of the unit according to the invention interchangeable with traditional mechanical cylinders, within the seat provided in the body of the lock.

For constructional and assembly reasons the body of the cylinder 2, which as will be seen hereinafter contains the entire mechanical, electrical and electronic part, is constructed in two parts joined together preferable by laser welding.

The cylinder 2 of the unit of the invention comprises in its cylindrical portion an outer protection ring nut 8, provided with an aperture 10 for insertion of the key 4.

Immediately inwards of said ring nut 8 there is provided an annular winding 12, forming the antenna of the cylinder 2. In a position concentrically on the inside of the antenna 12 and facing the protection ring nut 8 there is provided an operating bush 14, which is free to move axially within the cylindrical portion of the cylinder 2, guided by a guide ring 16, and has an axial cavity housing a body 18, forming the seat for the key 4.

The operating bush 14 is also provided in its lower part with an appendix 17, the function of which is described in detail hereinafter.

The body 18, which forms the seat for the key 4, comprises two axial cavities, namely a cavity 20 facing the protection ring 8 and of substantially rectangular cross-section to receive the end of the key 4 and rotationally couple it, and another cavity 22 facing in the opposite direction and housing a spring 24 which returns said bush 14 to its rest configuration.

Besides being movable rotationally relative to the bush 14, the body 18 is also movable axially thereto and is consequently telescopically movable relative to a central pin 26 also movable rotationally to the cylinder 2 and to which the pawl 6 is applied.

For this purpose the central pin 26 is provided with an axial cavity 28 housing the body 18.

In the outer surface of that portion of the central pin 26 corresponding to the axial cavity 28 there are provided a plurality of longitudinal grooves 30 for guiding and engaging an anti-rotation ring 32 axially movable along said central pin 26 and comprising frontal toothing 34 arranged to engage in corresponding fixed counter-toothing 36, rigid with the body of the cylinder 2.

In the outside of the anti-rotation ring 32 there is provided a circumferential groove 38 for engaging and operating an arm 40 of a three-arm lever 42, which is mounted on a pin 44 fixed to the cylinder 2 and is associated with a spring 46, which in the absence of external forces maintain the arm 40 in a condition in which it axially urges the anti-rotation ring 32 to cause the toothing 34 to engage the counter-toothing 36.

The cylindrical portion of the cylinder 2 also houses a substantially cylindrical release ring 48, which is axially movable within its seat and is provided lowerly with a fin 50 opposing the second arm 52 of the three-arm lever 42.

The third arm 54 of the three-arm lever 42 faces downwards and, when in its rest state, opposes the arm 56 of a slide 58 movable perpendicularly to the axis of the central pin 26.

More specifically the slide 58, which is slidable along a wall of the radial appendix of the cylinder 2 in a direction perpendicular to the axis of the central pin 26, comprises a portion provided with a permanent magnet 60, and another portion 61 hinged to the preceding and provided with a winding 62.

Between the two portions of the slide 58 there is interposed a spring 64, which when other forces are absent acts in the sense of maintaining the two portions close together, so that the winding 62 coaxially embraces the magnet 60.

The portion 61 of the slide 58 is also provided with a tooth 66 arranged to engage the toothed peripheral portion 68 of a flywheel-magnet 70 when the two slide portions are at their greatest distance apart.

The flywheel-magnet 70 forms the external rotor of a generator with an inner stator 72. The flywheel-rotor 70 is also provided on a front wall with a plurality of teeth 74 engagable by corresponding arms 76 formed in a thin plate which is rigid with a pinion 78 and forms a kind of free wheel, in the sense that for rotation of the pinion 78 in one direction of rotation it couples it to the flywheel-rotor 70, whereas for the other direction of rotation it maintains it uncoupled therefrom.

The pinion 78 engages a toothed sector 80 rotatable between two end positions by virtue of its pivoting about a pin 82 rigid with the cylinder 2 and also acting as a support for a spring 84 which maintains said sector in one of its two end positions.

On another pin 86, separate from the pin 82, there is applied to the toothed sector 80 a connecting rod 88, which is maintained in its rest position by a spring 92. That end of the connecting rod 88 not hinged to the toothed sector 80 is hinged to a second connecting rod 93 pivoted on a pin fixed to the cylinder 2. The second connecting rod 93 is provided with a slide roller 90 maintained in contact with the appendix 17 of the operating bush 14 by a spring 114.

The radial appendix of the cylinder 2 also internally houses the cylinder control logic, comprising a microprocessor 96 mounted, together with a capacitor, on an electronic circuit 98, to which there are connected a cable originating from the antenna 12, a cable originating from the stator 72 of the generator, and a cable connected to the winding 62 of the slide 58.

The key 4 comprises a head 100 and a shank 102. The head houses a small electronic circuit 104 with microprocessor 106 and a winding 108 which embraces a ferrite core 1107 which extends into the shank 102 to link with the winding 12 of the cylinder 2 when the key 4 is completely inserted in it.

The end of the shank 102 of the key 4 is complementary in shape to the cavity 20 provided in the body 18.

Figure 2:
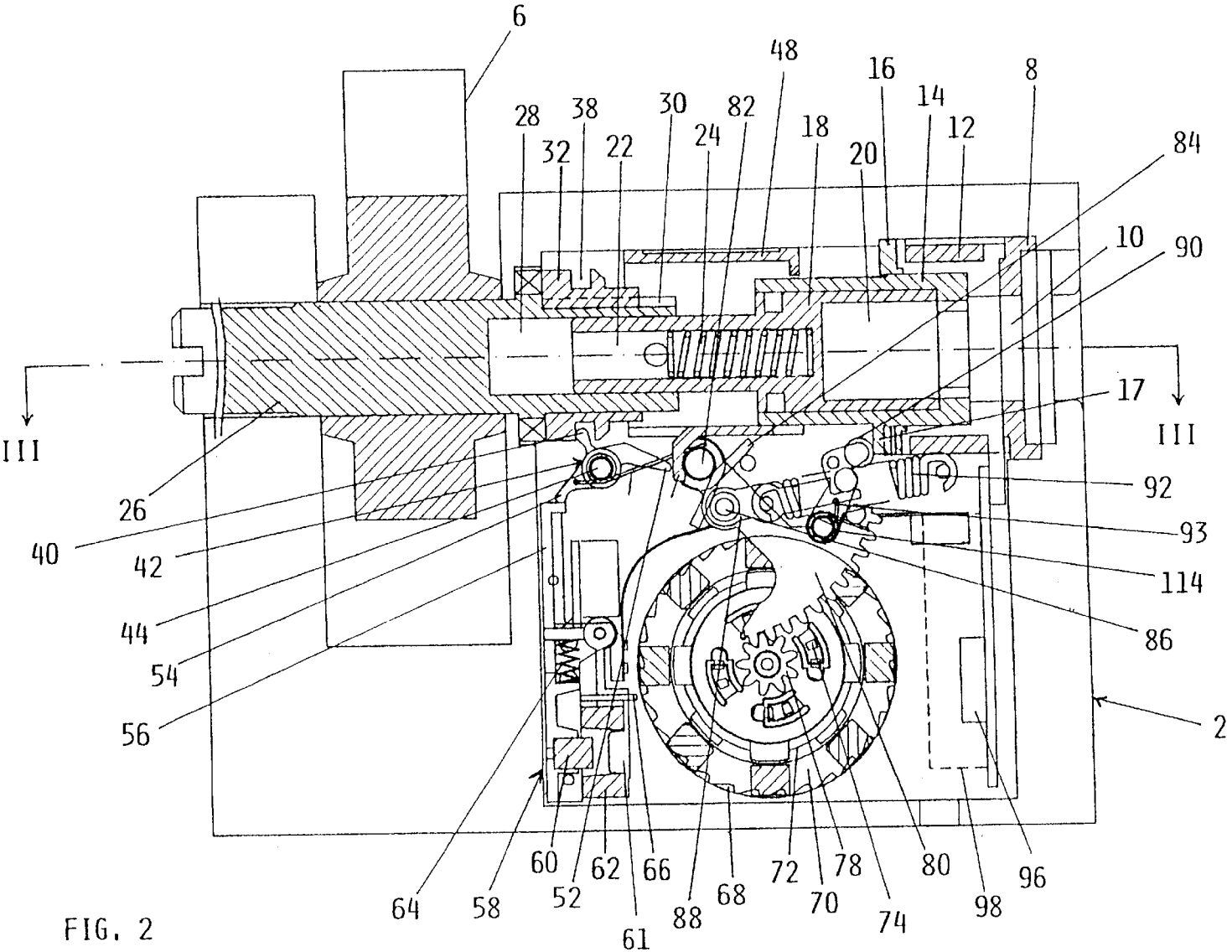
FIG. 2 is a longitudinal section therethrough on the line II—II of FIG. 3.
Figure 3:
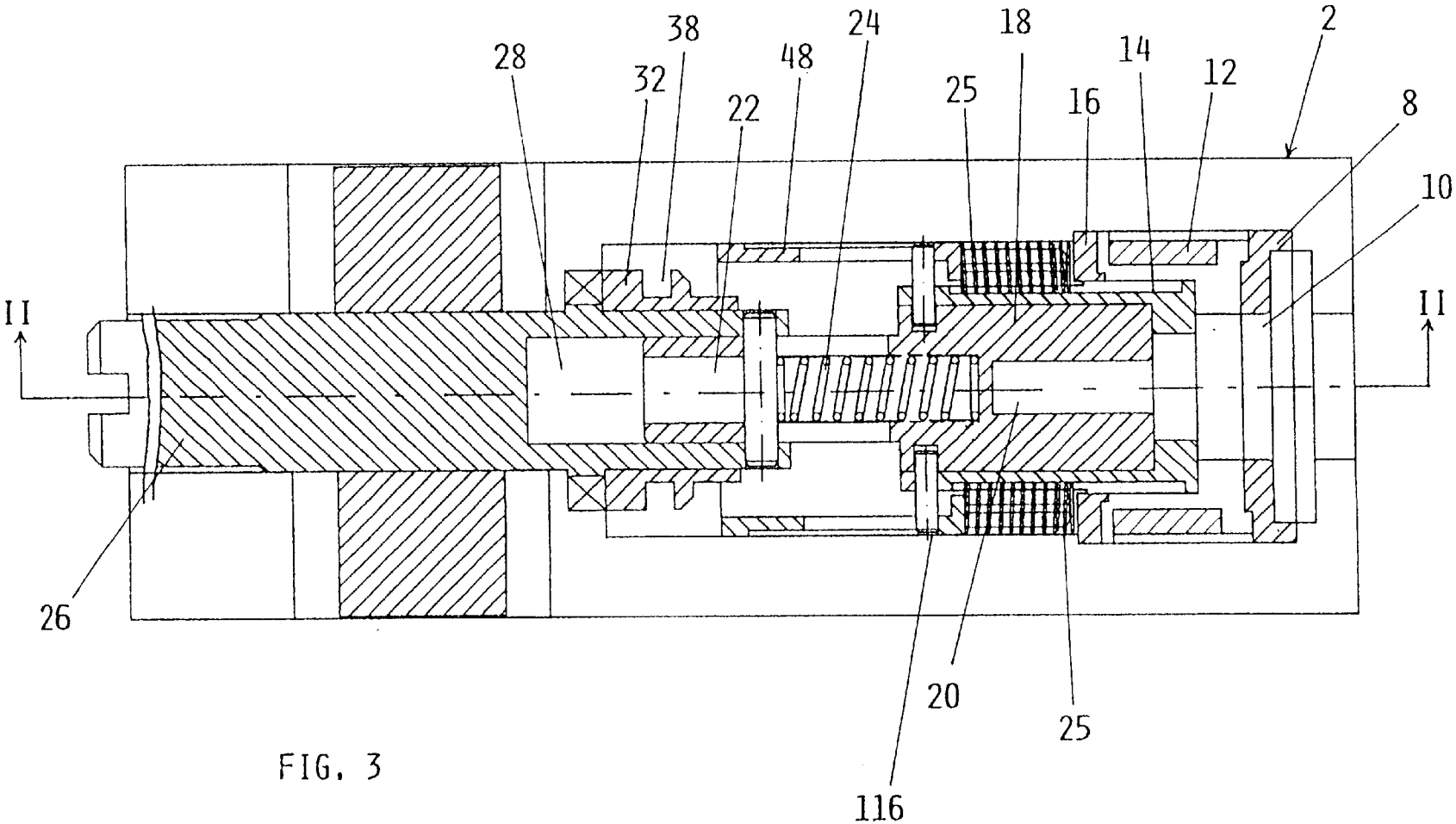
FIG. 3 is a longitudinal section therethrough on the line III—III of FIG. 2.

The cylinder-key of the invention operates in the following manner. When in the rest condition shown in FIGS. 1–3:

- the spring 24 urges the body 18 to maintain the operating bush 14 as close as possible to the protection ring 8,
- under the effect of the spring 46, the three-arm lever 42 maintains by means of its arm 40 the anti-rotation ring 32 engaged via its the frontal toothing 34 with the fixed counter-toothing 36, to hence block its rotation, correspondingly also blocking the rotation of the central pin 26 and the pawl 6, by virtue of the constraint provided by the longitudinal grooves 30,
- the spring 84 maintains the toothed sector 80 in the angular end-of-travel position shown in said FIGS. 1–3,
- the roller 90 is maintained adhering to the appendix 17 of the operating bush 14 by the direct effect of spring 114 which acts on the second connecting rod 93, by the indirect effect of the spring 92 which acts on the connecting rod 88, and by the indirect effect of the spring 84 which acts on the connecting rod 88 via the toothed sector 80,
- the spring 64 maintains the portion 61 of the slide 58 disengaged from the tooth 68 of the flywheel 70.

Under these conditions, in which rotation of the pawl 6 is blocked, inserting the end of a key 4 into the cavity 20 of the body 18 causes the body and the bush 14 to move axially, consequently loading the spring 24 and a pair of springs 25 As the body 18 advances within the bush 14, its appendix 17 pushes the roller 90 of the second connecting rod 93, which acts on the connecting rod 88 to cause the toothed sector 80 to rotate clockwise (observing FIG. 2).

During this movement the springs 114, 92 and 84 are loaded, and at the same time the pinion 78 is rotated, which however does not rotate the flywheel 70 because of its free-wheel coupling therewith.

Figure 4:
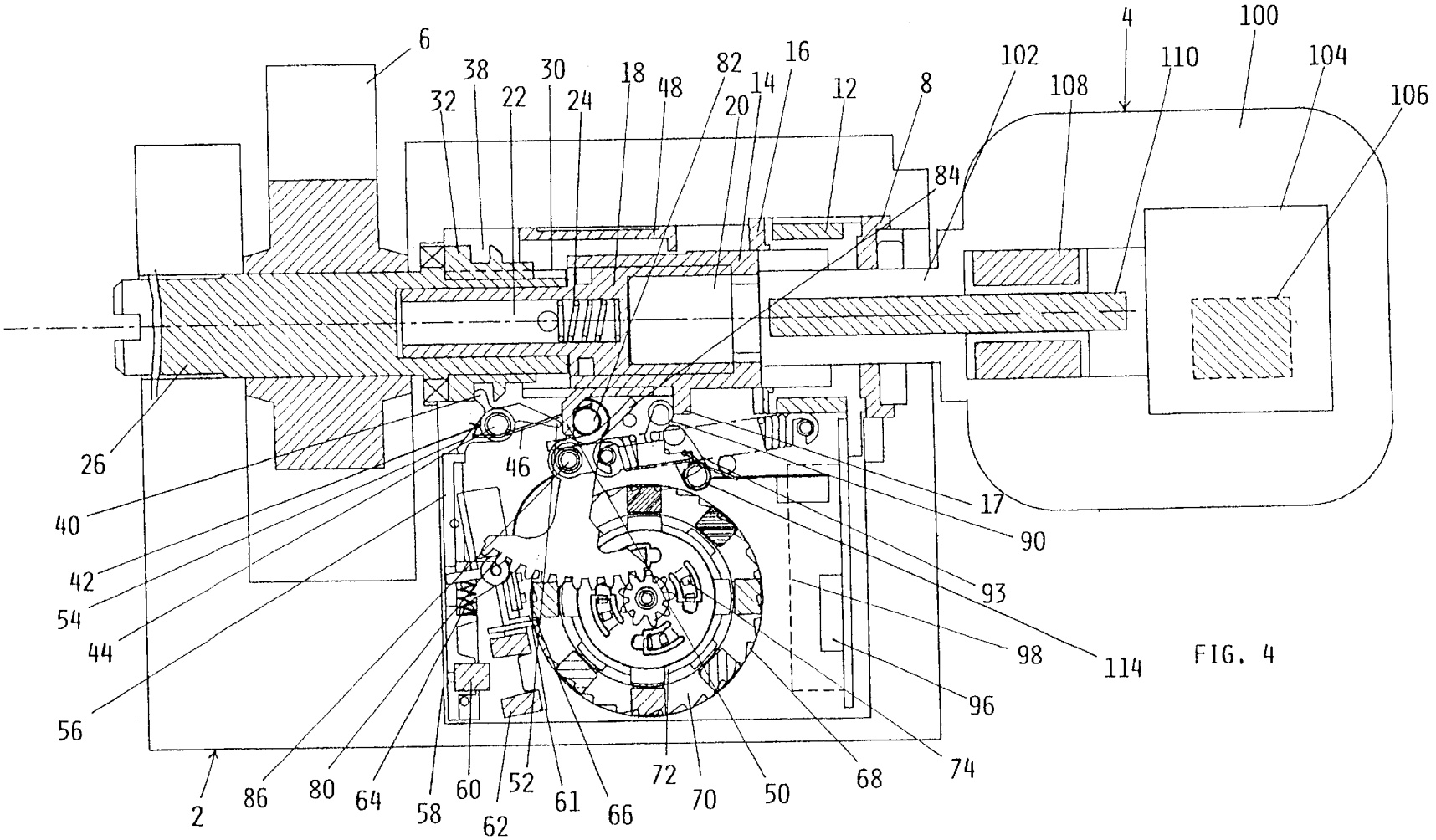
FIG. 4 is the same view thereof as FIG. 2 but with the key inserted, and shown at the moment immediately preceding the triggering of the generator.

Because of the particular form of the connecting rods 88, 93, as the direction of advancement of the roller 90 imposed by the effect of the connecting rods 88, 93 is at an angle to the direction of advancement of the bush 14, at a certain moment the reaction between the connecting rod 88 and the connecting rod 93 is lacking, this corresponding to a condition of virtually total insertion of the key 4 (see FIG. 4). At the moment in which this action lacks, the elastic reaction of the spring 84 acts on the toothed sector 80, which tends to return suddenly into its rest position, causing rotation of the pinion 78, which in this direction drags the flywheel-rotor 70 into rotation.

The rapid rotation of the flywheel-rotor 70 generates an electric current which charges the capacitor This powers the microprocessor 96 of the cylinder 2 and also powers the microprocessor 106 of the key 4 by induction via the coupling between the winding 12, the ferrite core 110 and the winding 108.

By means of the inductive coupling, the microprocessor 96 transmits to the microprocessor 106 its own code and a command to transmit the identifying code contained in it. The microprocessor 106, upon positive recognition of the code of the microprocessor 96 answers, transmitting his own code. On receiving this code, the microprocessor 96 of the cylinder 2 compares it with those memorized in it and in the case of positive recognition causes the mechanical connection procedure between the key 4 and pawl 6 to commence.

This procedure comprises firstly feeding a command to the winding 62, which in this manner generates a magnetic field of opposite polarity to that of the permanent magnet 60, so as to overcome the elastic reaction of the spring 64 and cause the movable part 61 to withdraw from the fixed part of the slide 58. In this manner the tooth 66 present on said movable part 61 interferes with the peripheral toothing 68 of the flywheel-rotor 70, which is still moving and drags the entire slide 58 upwards. Following this sliding movement the arm 56 of the slide 58 acts on the arm 54 of the three-arm lever 42 to rotate it clockwise, ie in a direction such as to cause the anti-rotation ring 32 to slide axially towards the right along the central pin 26.

Figure 5:
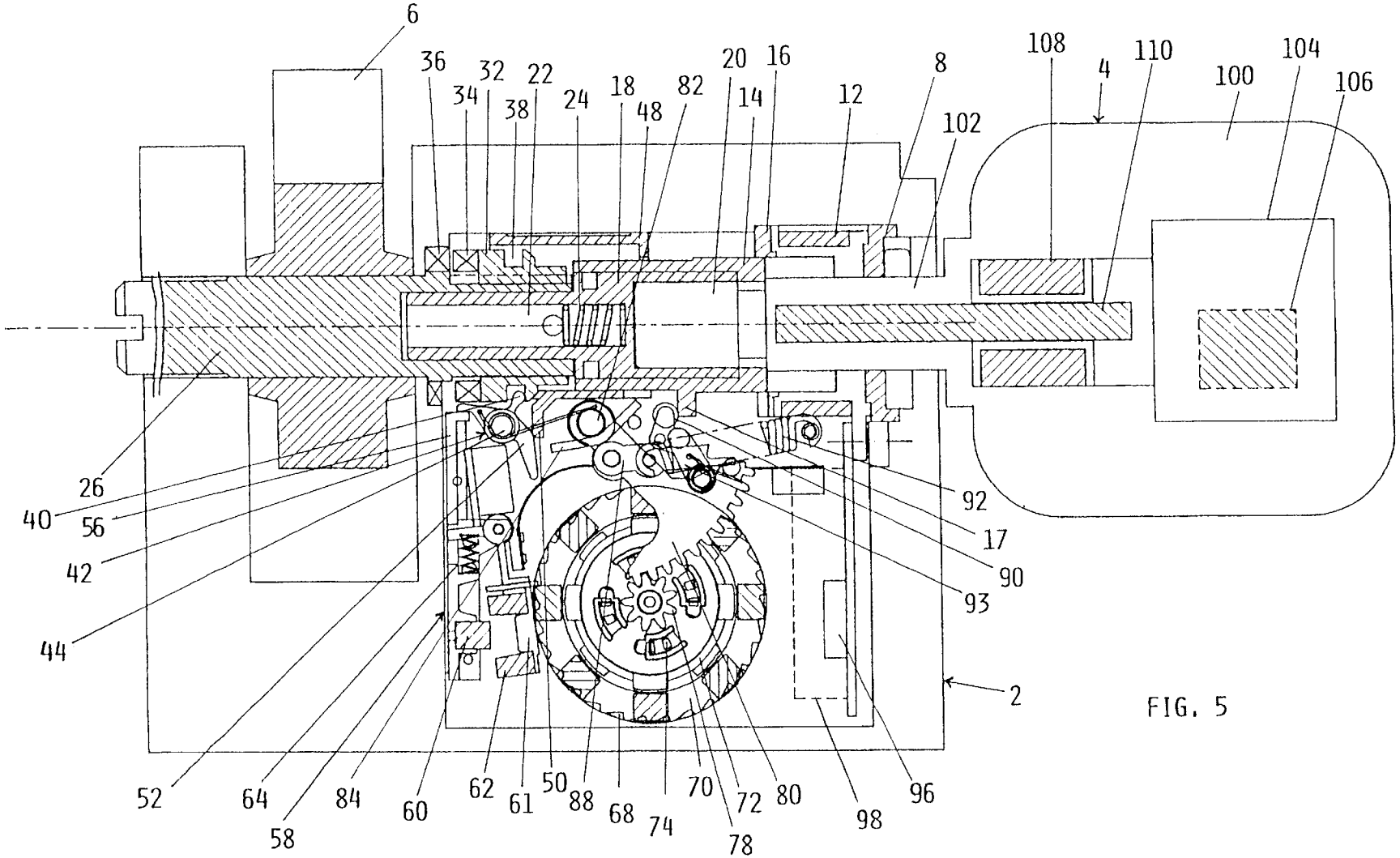
FIG. 5 is the same view thereof as FIG. 4, shown after the triggering of the generator, with the key recognized and the system released.
Figure 6:
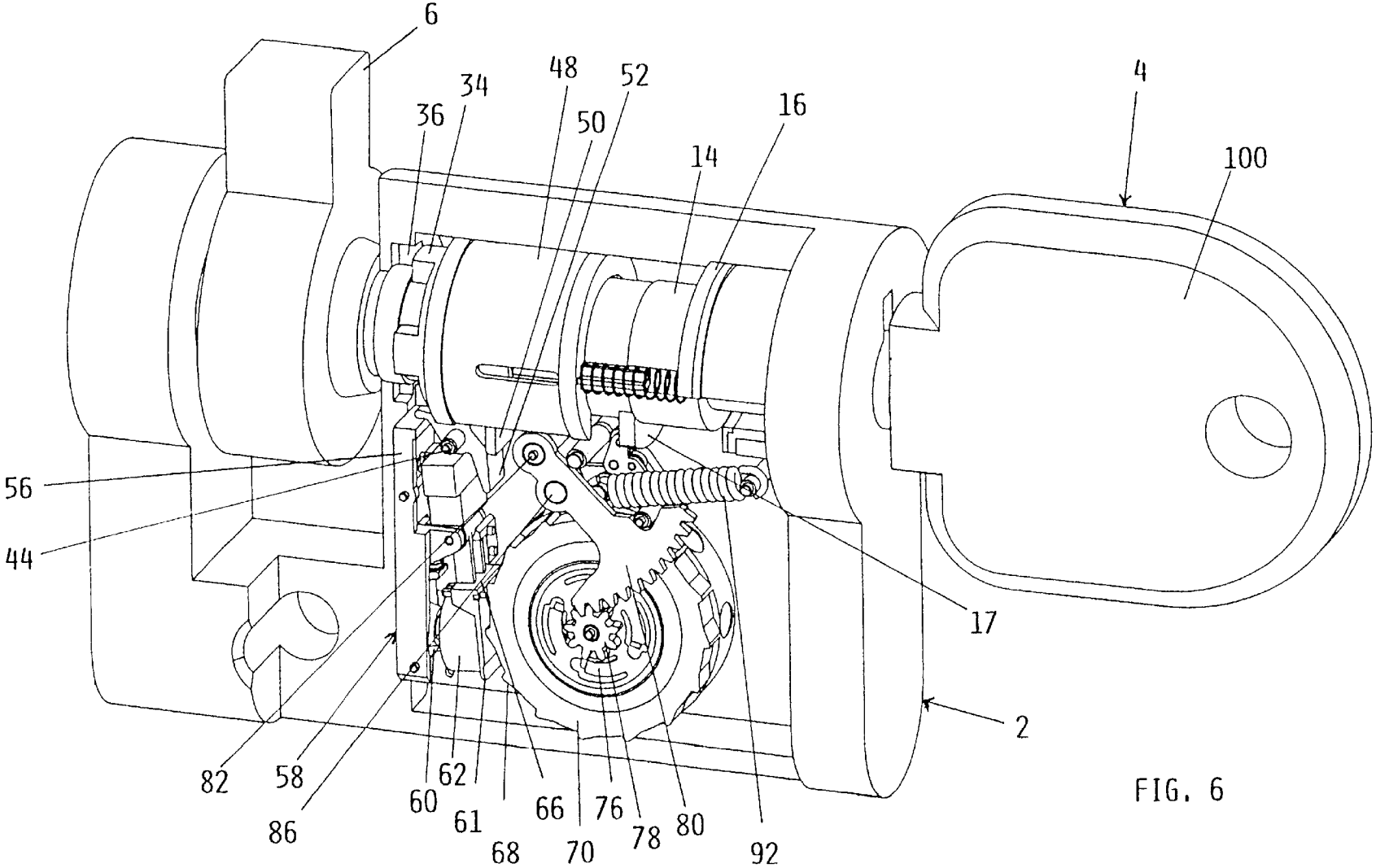
FIG. 6 is the same perspective view thereof as FIG. 1, but shown in the condition of FIG. 5.

As a result of this axial movement the frontal toothing 34 provided on the ring 32 disengages from the fixed counter-toothing 36 (see FIGS. 5 and 6) to enable pin 26, and with this the pawl 6, to rotate under the command given by the key 4. It should be noted that the rotation of the three-arm lever 42 brings its arm 52 downwards into a position such that the fin 50 of the release ring 48, urged leftwards by the spring 25, prevents return of the three-arm lever 42 to its rest state, hence ensuring that the anti-rotation ring 32 remains in a deactivated condition for the entire time for which the key 4 is inserted.

After the lock has been activated and the electrical energy used to control the winding 62 is exhausted, the spring 64 causes the movable part 61 to adhere to the fixed part of the slide 58 so that the tooth 66 can no longer interfere with the tooth 68 of the flywheel-rotor 70. The slide 58 can return to its rest condition freely by gravity. When the key 4 is removed, the springs 24 and 25 urge the bush 14 and the body 18 into their rest position. By means of the two pins 116, the bush 14 returns the release ring 48 to its rest condition, so removing reaction between the fin 50 and the arm 46 of the three-arm lever 42. The spring 46 causes the three-arm lever 42 to rotate into its rest position, this causing the anti-rotation ring 32 to return to its rest position, the arm 54 becoming repositioned in contact with the arm 56 of the slide 58, and the springs 92, 114 returning the connecting rods 88, 93 to their initial position as the roller 90 of 93 is no longer urged by the appendix 17 of the bush 14.

It will be clearly apparent that by virtue of the cylinder 2—key 4 unit of the invention, besides the advantages already obtainable with the unit of EP-B1-0771381 other significant advantages are obtained, and in particular absolutely constant electrical energy generated and accumulated by the capacitor, as this does not depend on the velocity of insertion and/or rotation of the key.

In this respect, this electrical energy is related only to the elastic reaction of the spring 84, after the key 4 during its insertion has passed beyond the release position of the toothed sector 80. Moreover the unit of the invention requires a smaller quantity of electrical energy to release the pawl, as the release action is essentially recovered by the rotation of the flywheel-rotor 70, and is hence essentially due to the elastic reaction of the spring 84.

We claim:

1. A mechano-electronically operated cylinder-key unit for locking, comprising:

a cylinder unit including:

a cylinder portion;

a pawl which operates a bar for locking/unlocking;

an electrical energy generator for powering an electronic circuit provided in said cylinder unit, said electrical energy generator being activated by a triggering member; and means for transforming said triggering member into kinetic energy so a deactivation movement of said pawl is achieved; and a key inserted into said cylinder unit, said key is provided with an electronic circuit whereby both said electronic circuits being provided with a control logic for recognizing and allowing operation of said pawl.

2. The cylinder-key unit according to claim 1, further comprising means for mechanically locking said pawl when said key is withdrawn or is not recognized.

3. The cylinder-key unit according to claim 1, wherein said key further comprises an identification code memorized in said key.

4. The cylinder-key unit according to claim 1, wherein said cylinder unit further comprises an identification code memorized in said cylinder unit, said identification code in said cylinder unit is in mutual recognition with an identification code in said key.

5. The cylinder-key unit according to claim 1, wherein said key and said pawl provides a mechanical connection, said mechanical connection is of direct type.

6. The cylinder-key unit according to claim 1, wherein said cylinder portion further comprises a radial appendix extending from said cylinder portion.

7. The cylinder-key unit according to claim 1, wherein said pawl is rigid with a pin, whereby a longitudinal toothing on an outer surface of the pawl provides an anti-rotational ring moveable between a locking position and a release position for said rotation of said pin.

8. The cylinder-key unit according to claim 7, wherein said anti-rotational ring further comprises a frontal toothing cooperating with a counter-toothing fixed to said cylinder portion.

9. The cylinder-key unit according to claim 8, further comprising a release ring axially movable between a position in which said anti-rotational ring is released, and a position in which said anti-rotational ring is locked.

10. The cylinder-key unit according to claim 9, further comprising a lever with a first, second and third arm, rotating between two separate angular positions, said first arm being an arm which controls said axial movements of said anti-rotational ring, said second arm being an arm providing mutual counteraction between said rotational movements of said lever and said axial movements of said release, and said third arm being an arm which rotates said lever.

11. The cylinder-key unit according to claim 10, wherein said lever is associated with a spring acting with a sense of maintaining said lever in a condition in which said first arm maintains said anti-rotational ring with the frontal toothing that is engaged in said fixed counter-toothing.

12. The cylinder-key unit according to claim 11, wherein said third arm comprises a member for operating said lever, said member being operating by kinetic energy stored by a rotor on positive recognition by said key being inserted.

13. The cylinder-key unit according to claim 12, wherein said operating member for said lever comprises a slide movable perpendicular to an axis of said lever, and an element hinged to said slide and movable between a rest position and a position in which it interferes, on positive recognition of said key by said cylinder, with said rotor of said electrical generator.

14. A cylinder-key unit according to claim 13, wherein said slide of said operating member is provided with a tooth interfering with a toothed lateral surface of said rotor.

15. A cylinder-key unit according to claim 13, wherein said slide moves in relative to said operating member by providing an electromagnetic means.

16. The cylinder-key unit according to claim 7, wherein said anti-rotational ring further comprises an engagement seat externally for controlling axial movements.

17. The cylinder-key unit according to claim 1, wherein said cylinder portion is provided with an outer protection ring in which an aperture is provided for insertion of said key.

18. The cylinder-key unit according to claim 17, wherein said cylinder portion further comprises a seat for an operating bush slidable axially between a position in which said electrical generator is at rest and a position in which it is triggered; and a ring for guiding said axial movements of said operating bush.

19. The cylinder-key unit according to claim 18, wherein an interior of said operating bush is provided with an axially movable body in which there is provided a seat for said key, said axially movable body being provided with a cylindrical portion engaging in a corresponding cylindrical cavity provided in a central pin of said pawl and is movable axially but not rotationally within said cylindrical cavity.

20. The cylinder-key unit according to claim 19, wherein said cylindrical portion of said axially movable body houses a spring retained in its seat by a diametrical pin which rotationally constrains said axially movable body to said central of said pawl.

21. The cylinder-key unit according to claim 1, further comprising:

a pinion rigid with a rotor of said electrical generator;

a toothed wheel portion engaging with said pinion which is associated with a spring; and a system of connecting rods, which on inserting said key into said cylinder portion loads said spring to the extent that it releases said toothed wheel and consequently triggers an operation of said electrical generator.

22. The cylinder-key unit according to claim 21, further comprising a freewheel device, said freewheel device is provided between said pinion and a rotor.

23. The cylinder-key unit according to claim 1, further comprising:

a capacitor in said electronic circuit which is charged by said electrical energy and said control logic;

said electronic circuit in said key containing the control logic, whereby said cylinder portion and key being mutually coupled inductively via a winding provided in said key;

a magnetic core provided in said key; and a winding providing in said cylinder portion which is linked with said core when said key is inserted into said cylinder portion.

* * * * *